US006213554B1

(12) United States Patent
Marcoux et al.

(10) Patent No.: US 6,213,554 B1
(45) Date of Patent: Apr. 10, 2001

(54) LIFT CHAIR

(75) Inventors: Yvan Marcoux, St. Joseph; André Veilleux, St. Honoré, both of (CA)

(73) Assignee: Groupe Myca, Honore (CA)

( * ) Notice: Subject to any disclaimer, the term of this patent is extended or adjusted under 35 U.S.C. 154(b) by 0 days.

(21) Appl. No.: 09/390,906

(22) Filed: Sep. 7, 1999

(51) Int. Cl.[7] ..... A47C 1/00
(52) U.S. Cl. ..... 297/330; 297/DIG. 10
(58) Field of Search ..... 297/330, DIG. 10

(56) References Cited

U.S. PATENT DOCUMENTS 4,083,599 * 4/1978 Gaffney ..... 297/330 X
5,024,486 * 6/1991 Auel ..... 297/330
5,061,010 * 10/1991 LaPointe ..... 297/330 X
5,641,201 6/1997 Casey et al. ..... 297/DIG. 10 X
5,895,093 4/1999 Casey et al. ..... 297/330 X
5,931,532 8/1999 Kemmerer et al. ..... 297/330

* cited by examiner

*Primary Examiner*—Peter M. Cuomo
*Assistant Examiner*—Rodney B. White
(74) *Attorney, Agent, or Firm*—Wall Marjama & Bilinski

(57) ABSTRACT

A lift chair includes a chair frame, a stationary base section, and a motorized lift mechanism. Engagement of the motorized lift mechanism causes movement of a lift frame which is connected to the chair frame to cause movement from a first recumbent position to a second tilted position and allowing the user to be assisted to a standing position. Preferably, the chair can be rocked back and forth longitudinally, with the rocking motion being disabled while the lift mechanism is engaged. According to another preferred aspect, the chair can include a reclining back section which operates independently of the lift mechanism.

20 Claims, 5 Drawing Sheets

LIFT CHAIR

FIELD OF THE INVENTION

The invention relates to a improved lift chair that allows handicapped or other individuals to be assisted from an assumed initial sitting position to a substantially vertical or standing position and more particularly to a lift chair having rocking or gliding capability when the chair seat is in a recumbent position.

BACKGROUND OF THE INVENTION

It is often difficult, if not impossible at times, for handicapped or older individuals to assume a standing position from a recumbent position; that is, from a sitting posture.

To that end, a number of so-called "lift" chairs have been developed which assist seniors or handicapped individuals to achieve a standing position from the chair using a motorized mechanism to incline or otherwise move the chair seat.

In U.S. Pat. No. 5,641,201, issued to Casey et al., a free standing chair can be converted into a lift chair using a stationary base to which the chair is attached as well as a compact lift mechanism. The lift mechanism includes a motorized assembly mounted from the front of the chair to tilt the forward end thereof upon activation of the motor.

A desire in industry persists for lift chairs which incorporate other salient features found in conventional chair counterparts. Prior to the invention, for example, it has not been possible to provide a safe and reliable lift mechanism for a rocking or adjustable reclining chair.

SUMMARY OF THE INVENTION

It is a primary object of the present invention to overcome the above stated problems relating to lift chairs known in the art.

It is another primary object of the present invention to provide a lift chair which reliably allows the user to more easily assume a substantially vertical or standing orientation.

It is another primary object of the present invention to provide a lift chair which can be manufactured using a simple and reliable mechanism design.

It is a further primary object of the present invention to provide a lift mechanism for a rocking and/or reclining chair which is both safe and reliable.

Therefore and according to a preferred aspect of the present invention, there is provided a lift chair comprising: a chair frame portion, a stationary base portion disposed beneath the chair frame portion, and a motorized lift mechanism attached to the base portion which causes the seat of the chair to be moved between a first seated position and a second tilted position.

The motorized lift mechanism is supported at the rear of the stationary base section and engages the front of a movable lift frame so as to move the chair seat both upwardly and forwardly, thereby tilting the seat to permit the user to more easily assume a standing position from an initial recumbent position.

Moreover, and prior to initiation of the lift mechanism, the chair is capable of freely gliding or rocking back and forth longitudinally. After the lift mechanism has been engaged, however, the rocking mechanism of the chair is disabled to protect the user.

A feature of the present invention is the ability of the chair to reliably be raised and tilted forward from an initial recumbent position, thereby allowing the user to more easily assume a vertical orientation.

Another feature of the present invention is that the chair can be moved back and forth longitudinally in a gliding or rocking mode when the lift mechanism is not engaged, in which rocking motion is prevented automatically after the lift mechanism has been engaged by the user.

Another feature is that the chair seat back can be reclined independently of the stationary base or the lift frame of the chair.

An advantage of the chair is that the rocking motion can be disabled automatically upon activation of the lift mechanism, and enabled when the lift mechanism has returned the chair to a recumbent position.

These and other objects, features, and advantages will be apparent from the following Detailed Description which should be read in conjunction with the accompanying drawings.

BRIEF DESCRIPTION OF THE DRAWINGS

FIG. 3(*a*) is an enlarged view of the glide disabling mechanism of the lift chair of FIGS. 1–3;

FIG. 4(*a*) is an enlarged view depicting the enablement of the glide disabling mechanism when the chair reaches the raised position of FIG. 4.

DETAILED DESCRIPTION

The following discussion relates to a lift chair made in accordance with a specific embodiment of the present invention. Throughout the course of discussion, several terms such as "top", "lower", "upper", "bottom", "transverse", "lateral" and the like are frequently used. These terms are not intended to be limiting, but rather provide a frame of reference in regard to the accompanying drawings.

Figure 1:
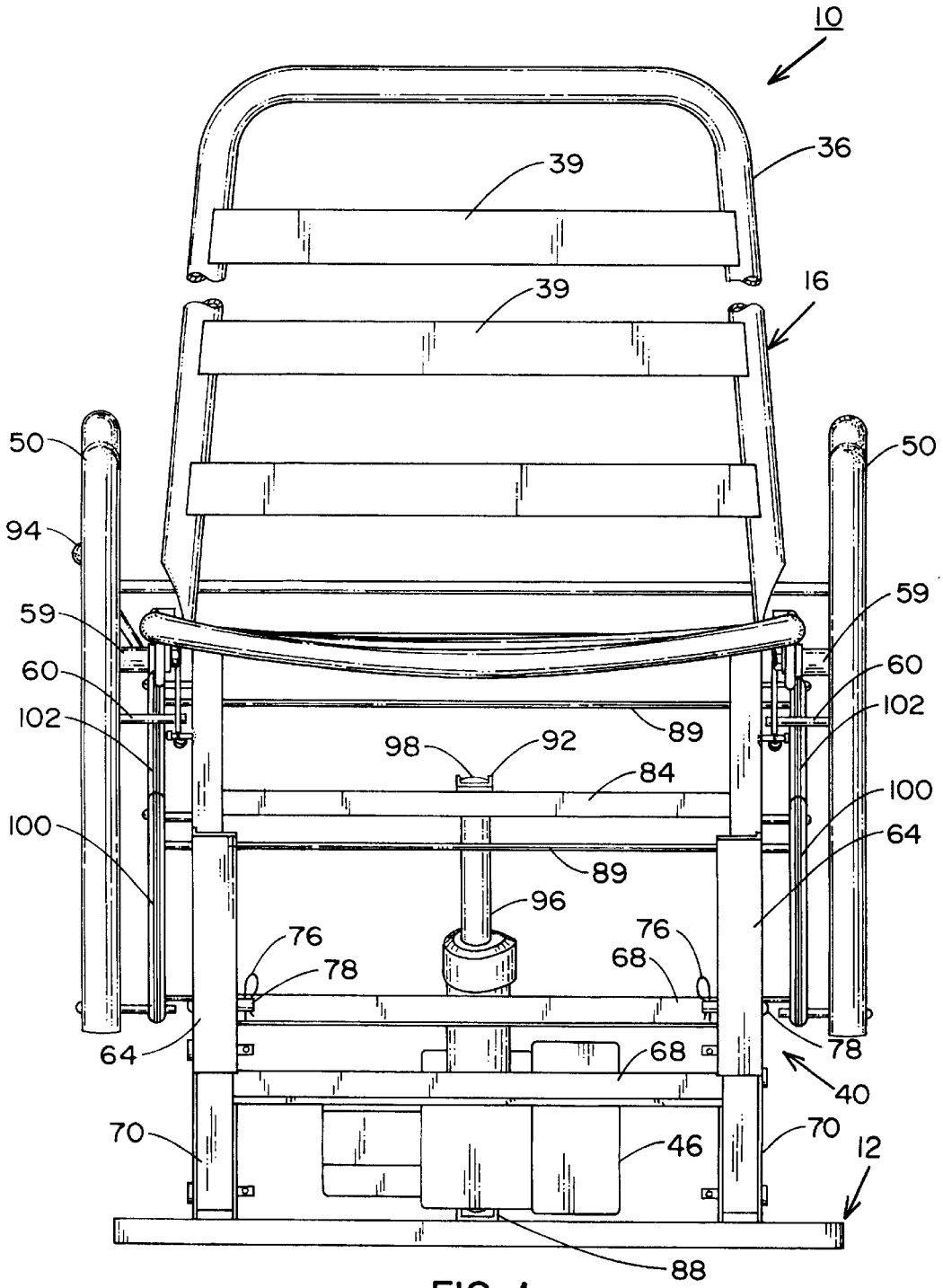
FIG. 1 is a front perspective view of a lift chair made in accordance with a preferred embodiment of the present invention.
Figure 2:
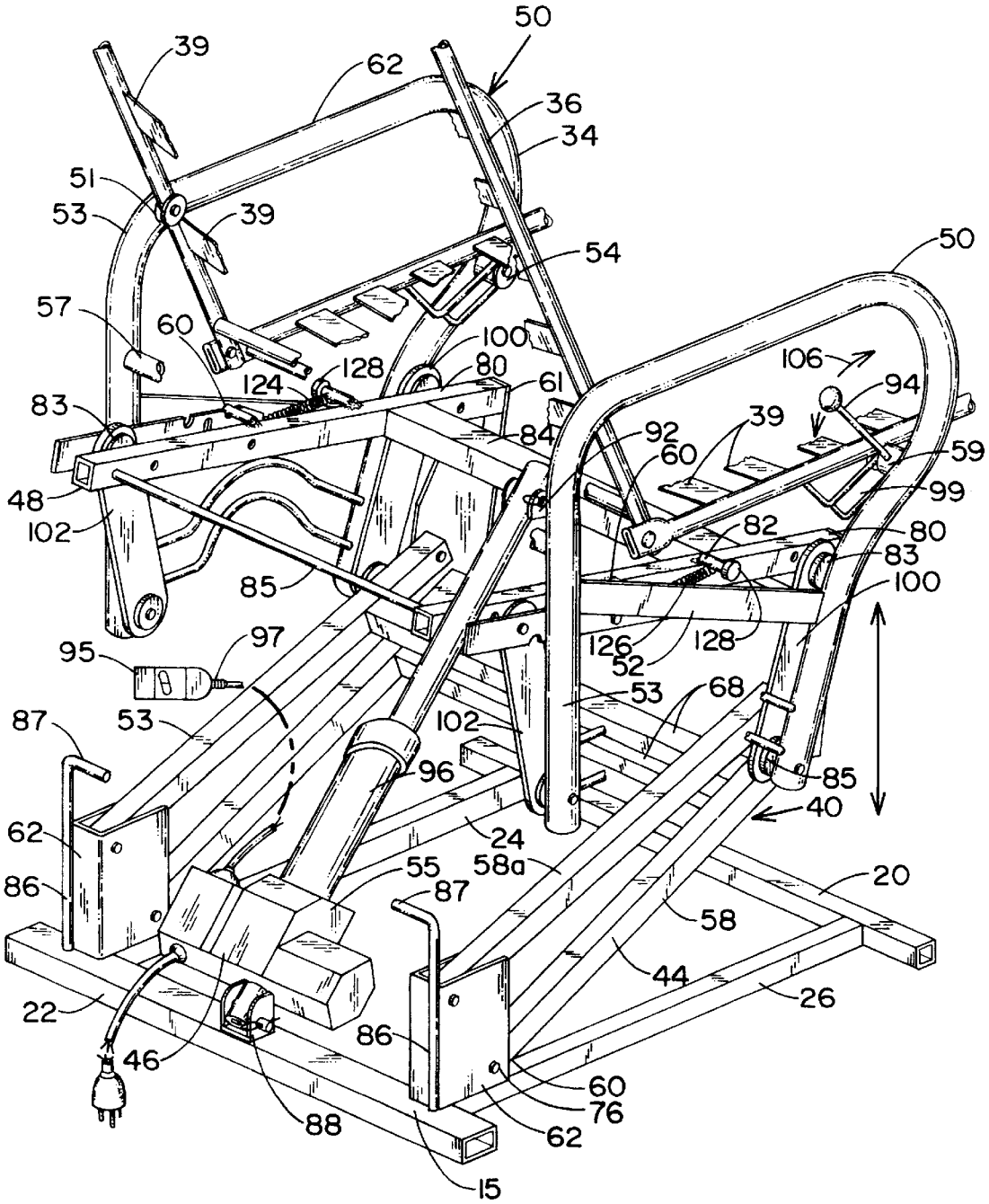
FIG. 2 is a partial rear perspective view of the lift chair of FIG. 1.

Referring now to FIGS. 1 and 2, a lift chair 10 is made in accordance with the preferred embodiment including a stationary base portion 12, a chair frame portion 16, and an interconnected lift mechanism 19, the details of which will now be described in greater detail.

First, the stationary base portion 12 includes respective front and back pieces 20, 22, each being interconnected by a spaced pair of parallel longitudinally extending cross pieces 24,26 which combine to define a rectangular configuration. Each of the above components of the stationary base portion 12 are preferably hollow tubular members made from steel or other suitable material which are welded or otherwise fastened together by known means. According to the present embodiment, each of the corners 30 on the bottom side 32 of the base section 12 include adjustable leveling guides 34 used by the user for leveling the chair 10.

Still referring to FIGS. 1 and 2, the chair frame portion 16 includes a seat back 36 and a seat bottom 38 each consisting of a tubular frame having a number of spaced slats 39 used to retain cushioned sections (not shown). The seat back 36 and the seat bottom 38 are further attached to the rear leg 53 and front leg 54, respectively, of a pair of parallel and vertically disposed arm supports 50 using threaded fasteners or the like which are inserted into respective pilot sections 51, 59. The spacing between the arm supports 50 and the outer ends of the front and back pieces 20, 22 of the stationary base portion 12 define the overall width of the lift chair 10. A stabilizer arm 52 interconnects each of the arm support legs 53, 54 while a back stabilizer bar 57, only partially shown in FIG. 2, interconnects the parallel arm supports 50. A pin 60 inwardly projects from each stabilizer arm 52, the purpose of which is detailed in the operational description which follows below. Cushioned pad sections (not shown) are attached to a pair of longitudinal arm rests 62, each rest spanning the top of the rear and front legs 53, 54 of the arm supports.

The seat bottom 38 of the chair frame portion 16 is inwardly angled as seen from front to back in this position, with the degree of incline being adjustable through a lever 94, FIG. 2, adjacently disposed at the front of the chair 10 over a range defined by a slotted area 99, FIG. 2. Rotation of the lever 94 in the direction shown as 106, FIG. 2, allows the seat bottom 36 and seat back 38 to slide along the slot 99 to effect reclining of the chair frame portion 16 independently of the lift frame 40 and stationary base portion 12.

Still referring to FIGS. 1 and 2, the lift mechanism 19 of the invention includes a lift frame 40 and a motor drive assembly 46. The lift frame 40 includes an articulating lever portion 44, and an upper or top supporting portion 48. The articulating lever portion 44 includes two pairs of spaced tubular leg members 58, 58A. Each leg member pair 58, 58A is pivotally attached using metal pins at a lower end 60 thereof to a rear support 62, the rear support being welded or otherwise fixedly attached to the stationary base section 12 while upper ends 66 of the leg member pairs 58, 58A are pivotally attached to the lower end of a front support 64. Preferably, the front support 64 includes a plurality with separate aligned mounting holes 65 to allow additional tilt adjustment as described below.

The upper supporting portion 48 of the lift frame 40 is substantially rectangular in shape similar to that of the stationary base portion 12 and includes a pair of longitudinal sections 80 which are interconnected by a front section 84 and a rear stabilizing bar 85.

The front supports 64 interconnect the articulating lever portion 44 and the lift frame 40. More particularly, the upper end of each front support 64 is welded or otherwise fixedly attached to the front ends of the longitudinal sections 80 of the upper supporting portion 48. A stopper 86 having a horizontal support surface 87 projects above the top surface of each rear support 62, the function of which is clarified during the operational description which follows below. Finally, a pair of spaced transverse braces 68 spanning the width of the lift chair 10 interconnect each of the tubular leg member pairs 58, 58A of the articulating lever portion 44.

The motor drive assembly 46 of the lift mechanism 19 includes a motor support 88 provided in the center of the span of the top surface 15 of the rear piece 22 of the stationary base portion 12 which pivotally supports and retains a motor drive housing 55, such as those sold by Okin Antriebstechnik, GmβH, among others. The motor drive assembly 46 includes a piston 96 pneumatically or otherwise driven by a contained motor (not shown) with the output end 98 of the piston extending from the housing toward the front of the chair 10 and more particularly to a piston support bracket 92 provided in the rear facing side 90 of the front section 84 of the upper supporting portion 48. A hand-held remote control 95 is tethered by a control cable 97 to the motor drive housing 55, the drive assembly being powered through an external power supply (not shown) via a power cable 56 (only partially shown in FIG. 2). Details relating to the motor drive assembly 46 are commonly known in the field and require no further discussion except as needed to explain features of the invention.

As previously noted, the front supports 64 of the lift frame 40 interconnect the upper supporting portion 48 with the articulating lever portion 44. Furthermore, the chair frame portion 19 is pivotally interconnected to the upper supporting portion 48 of the lift frame 40 utilizing two spaced pairs of swings or pivot arms; namely, a front pair 100 and a rear pair 102. Each of the front and back swings 100, 102 are similarly constructed thin plate-like members which downwardly extend from exterior sides 82 of the longitudinal sections 80 of the upper supporting portion 48. More particularly and according to this embodiment, formed cylindrical pilot sections 83 projecting from the exterior sides 82 of the longitudinal sections 80 each include a center opening for receiving a threaded fastener aligned with a similarly sized opening in the upper ends of each of the swings 100, 102 while a similar pivoting connection is provided at the lower ends of each swing through a pilot section extending from the inward facing surface at the bottom of each of the front and rear legs 54, 53 of the arm supports 50 of the chair frame portion 16. More particularly, a bolt or other fastener is mounted through a metal bushing, the end of the bolt being secured by a pushnut. Each pair of swings 100, 102 is interconnected by a traverse axle 89 adjacent the upper ends thereof.

Figures 3, 3A:
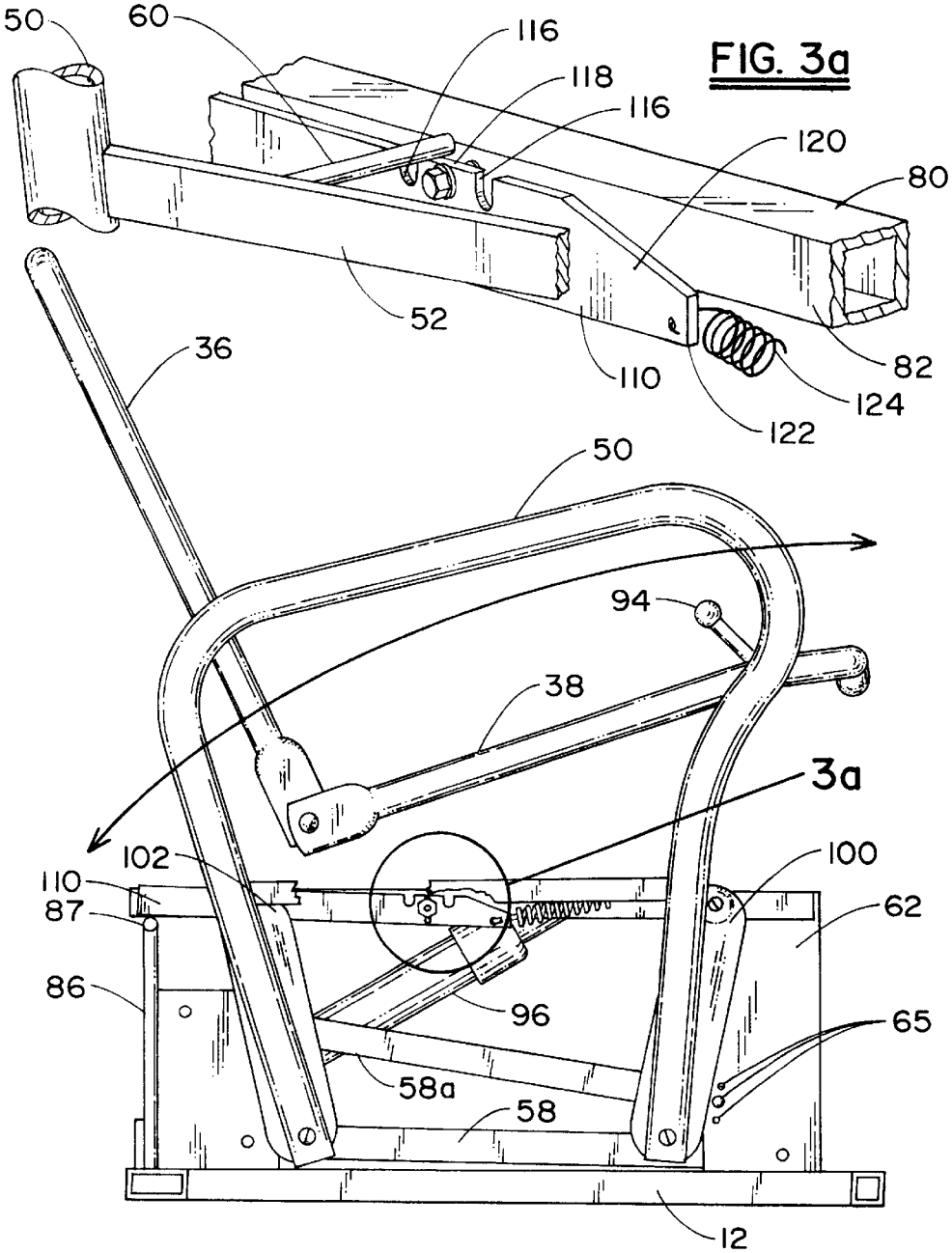
FIG. 3 is a side elevational view of the lift chair of FIGS. 1 and 2 as depicted in an initial rest position.

The above pivotal connections of the swings 100, 102 permits longitudinal rocking movement of the entire chair frame portion 16 relative to the fixed upper supporting portion 48 of the lift frame 40 while the lift chair 10 is in a normal rest position, FIG. 3, and prior to actuation of the lift mechanism.

Finally, and referring in part to FIGS. 2 and 3(*a*), a glide disabling mechanism is provided in the form of planar glide locking bars 110 attached to the exterior sides 82 of the longitudinal sections 80 of the upper supporting portion 48 between the pairs of swings 100, 102. The glide locking bars 110 are mounted to a respective exterior side 112 using a threaded fastener mounted through a center mounting hole disposed directly between a pair of spaced slots 116. A front end 120 of each glide locking bar 110 is connected to one end 122 of a tensioning spring 124 with the remaining end 126 of the spring being attached to a pin 128 outwardly extending from the exterior side 82 of the longitudinal sections 80 of the upper supporting section 48 of the lift frame 40. Each glide locking bar 1 10 includes a pair of spaced slots 116 formed in a top surface 118, the function of which is described in greater detail in the operational description below.

The operation of the herein described lift chair 10 will now be described with reference to FIGS. 3–5. Initially and prior to activation of the lift mechanism 19, as shown in FIGS. 3 and 3(*a*), the chair 10 is substantially horizontally disposed in a rest position with the chair frame portion 19 being freely able to glide back and forth longitudinally based on the pivotable connection of the front and rear swings 100,102 to the chair frame portion 16. In this depicted position, the lower pivoting legs 58A of the articulated lever portion 44 are substantially parallel with the top surface 15 of the stationary base portion 12, while the upper supporting portion 48 is also parallel to the base portion. The lower end of the front support 64 is in contact with the top surface 15 of the stationary base portion 12 while the rearmost end of each of the glide locking bars 112 and the longitudinal sections 80 of the upper supporting portion 48 are in direct contact with the horizontal support surface 87 of the stoppers 86. Tilt adjustments can also be made through selecting of one of the plurality of mounting holes 65 and removing a pin 76 attached to a through fastener 78 on either front support 64 to adjust the position of the lever legs 58A, as shown in FIGS. 1 and 5.

Depression of an UP button (not shown) on the remote control 95 initiates the motor drive assembly 46 and begins the lifting process which is herein sequentially described.

Actuation of the motor drive assembly 46 initially causes an outward extension of the piston 96 toward the front of the chair 10. As noted previously, the motor drive assembly 46 is pivotally but fixedly attached to the rear transverse piece 28 of the stationary base portion 12 via support 88. Therefore, the outward extension of the output end 98 of the piston 96 pushes against the center of the front section 84 of the upper supporting portion 48 through the support bracket 92. Because the piston 96 is obliquely attached to the front section 84, the initial slight forward extension thereof causes each of the glide locking bars 110 to lift slightly away from the horizontal support surface 87 of the stoppers 86 and moves the glide locking bars 110 upwardly due to the biasing of the tensioning spring 124 at the front end thereof such that the pin 60 inwardly extending from the stabilizer arm 52 of each of the vertical arm supports 50 of the chair frame portion 16 is brought into engagement with the top surface 118 of each glide locking bar 110. As the piston 96 continues to move forward, the front of the lift frame 40 is caused to pivot downwardly while the rear half thereof moves upwardly and forwardly.

Figure 4A:
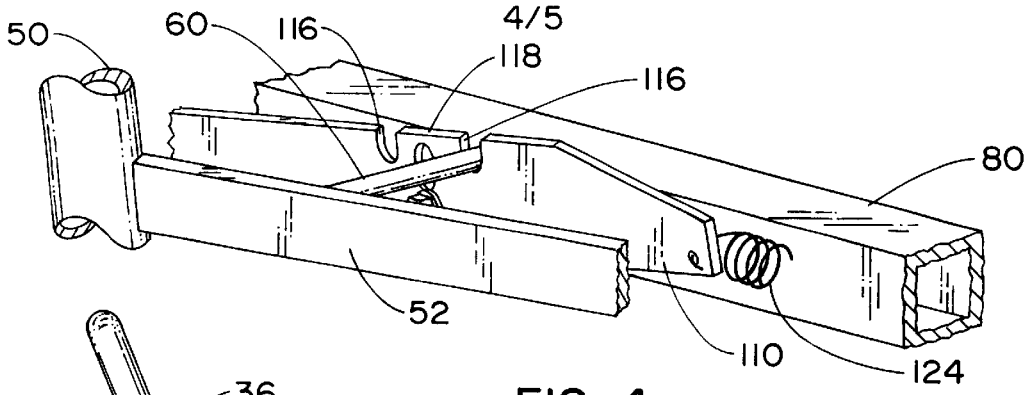
FIG. 4 is a side elevational view of the lift chair of FIGS. 1–3 in a glide lock position.
Figure 4:
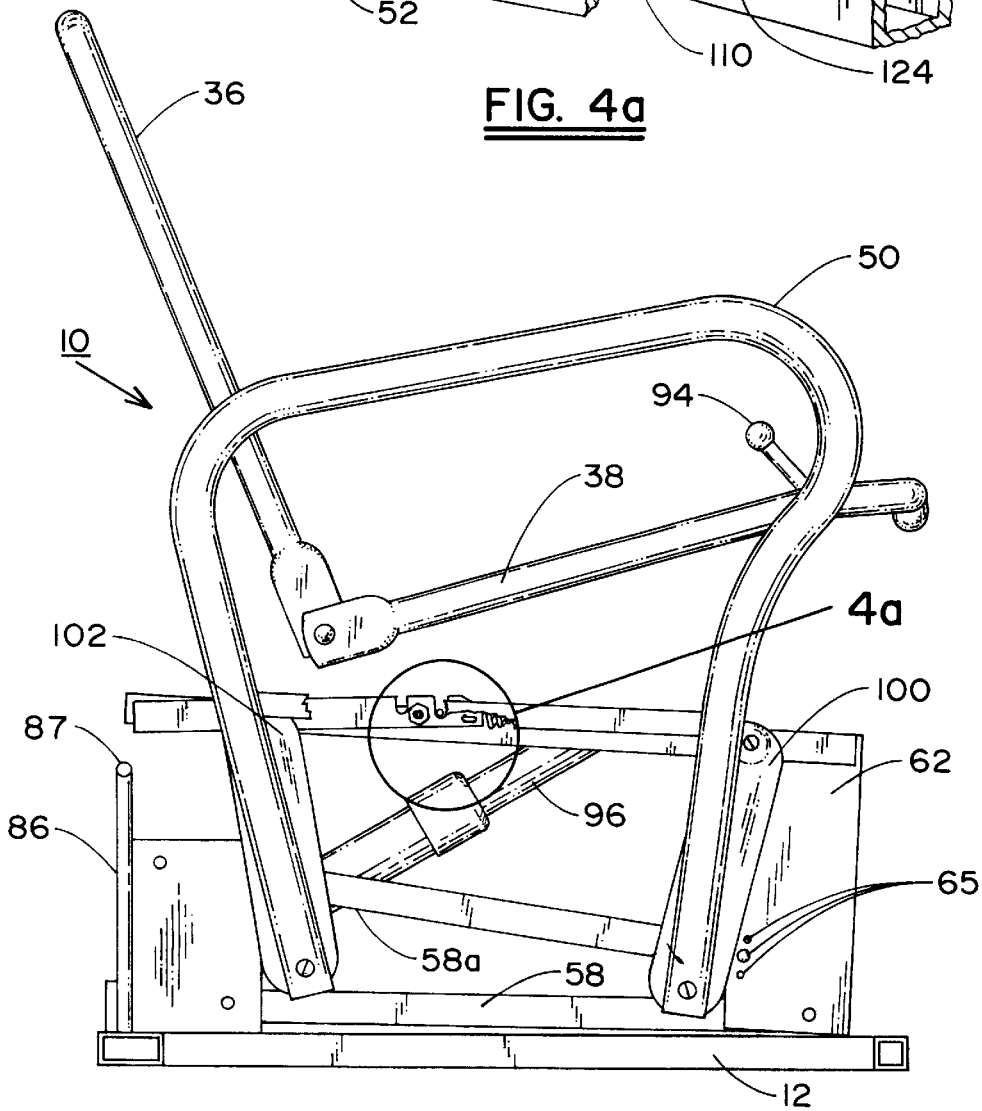
Figure 5:
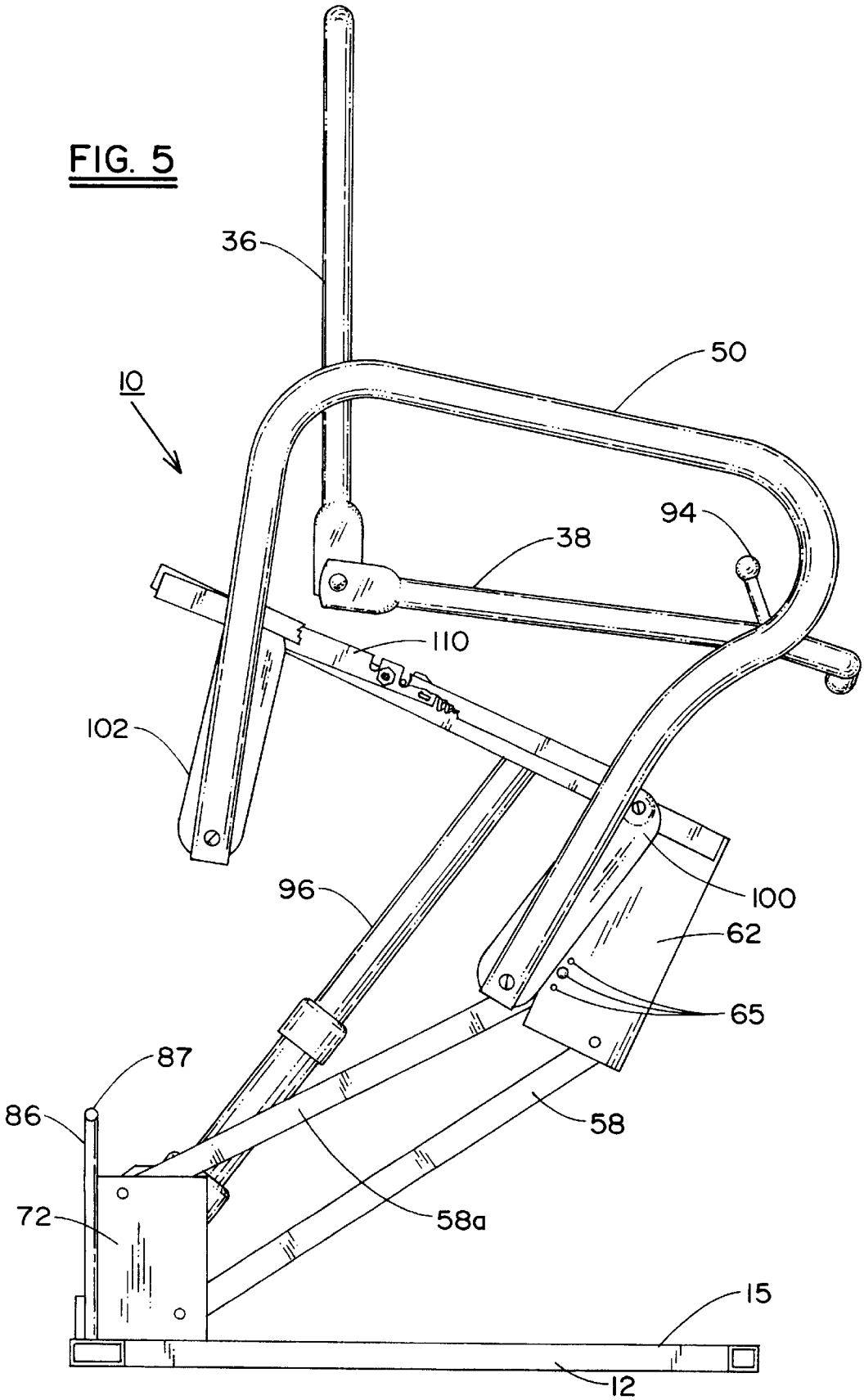
FIG. 5 is a side elevational view of FIG. 3, showing the lift chair in a fully tilted position.

As shown in FIG. 4(*a*), the above movement of the lift frame 40 continues until the inwardly directed pin 60 moves downwardly along the top surface 118 of the glide locking bars 110 and drops into locking engagement into one of the slots 116, the chair now being in a "glide locked" position. In this position, and as apparent from FIGS. 4 and 5, the chair frame portion 16 is fully immobilized with respect to the lift frame 40, with the swings 100, 102 being interconnected by transverse axle members 89. Any additional movement of the chair 10 thereafter requires the chair frame portion 16 and the lift frame 40 be moved in tandem.

As shown in FIG. 5, additional forward movement of the lift frame 40 due to the pushing force of the piston 96 continues with the upper supporting portion 48 being tilted forward based on the pivoting connection of the articulating arms 58, 58A with the front support 64. Continued outward movement of the piston 96 causes the front support 64 to lift away from the top surface 15 of the stationary base section 12 and pivot in a clockwise direction with the upper end of the front support being caused to tip forward. In the meantime, the connected leg pairs 58, 58A of the articulated lever portion 44 are also caused to pivot and lift upwardly to the position shown.

As a result, the upper supporting section 48 translates forwardly relative to the front and rear pieces 20, 22 of the stationary base section 20 with the front end of the upper support section 48 moving downwardly causing a forward tilt of the chair frame portion 16 as compared with the initial recumbent position of FIG. 3. The user is then able to more easily remove himself or herself from the chair 10.

Pressing the DOWN button (not shown) of the remote control 95 reverses the above sequence. That is, the piston 96 is retracted by the motor drive assembly 46, causing the upper portion of the lift frame 40 to be pulled toward the rear of the stationary base portion 20. As this movement commences, the front end of the upper supporting section 48 begins to drop with the movement of the chair frame portion 16 still being controlled only by the retraction of the piston 96. The front support 84 pivots in a counterclockwise direction as the articulating arms 58, 58A begin to rotate in a clockwise sense toward the stationary base portion 12 with the lower end of the front support 64 eventually engaging the top surface 15 thereof. The upper supporting portion 48 moves to an essentially horizontal attitude during the movement.

As the rear surface of the upper supporting portion 48 engages the horizontal support surface 87 of the projecting stoppers 86, the rearmost ends of the glide locking bars 110 are caused to pivot based on their connection to the tensioning spring 124, releasing the pin 60 from the slot 116 and thereby releasing the chair frame portion 16 from the lift mechanism 19 and permitting rocking or gliding movement to resume.

PARTS LIST FOR FIGS. 1–5

10 lift chair
12 stationary base portion
15 top surface (base)
16 chair frame portion
19 lift mechanism
20 front piece
22 back piece
24 cross pieces
26 cross piece
30 corners
32 bottom side
34 leveling guides
36 seat back
38 seat bottom
39 slats
40 lift frame
44 articulating lever portion
46 motor drive assembly
48 upper supporting portion
50 arm supports
51 pilot section
52 stabilizer arm
53 rear leg
54 front leg
55 motor drive housing
56 power cable
57 back stabilizer bar
58 tubular leg members
59 pilot section
61 threaded fastener
62 longitudinal arm rests
64 front supports
65 mounting holes
66 upper ends
68 braces
70 rear supports
76 pin
78 fastener
80 longitudinal sections
82 exterior sides
83 pilot section
84 front section
85 pilot section
88 motor support
89 transverse axle members
90 rear facing side
92 support
94 canting lever
95 remote control
96 piston
97 control cable
98 output end

99 slot

100 front swings or pivot arms

102 rear swings or pivot arms

104 mounting holes

110 glide locking bars

112 exterior sides

114 side pieces

116 slots

118 top surface

120 front end

122 spring end

124 tensioning spring

126 spring end

128 pin

Though the preceding has been described in terms of a preferred embodiment, it will be readily apparent that modifications and variations are possible within the scope of the invention as defined by the following claims.

We claim:

1. A lift chair comprising:

a chair frame portion;

a stationary base section disposed beneath said chair frame portion; and a motorized lift mechanism attached to the stationary base section, said lift mechanism having means for moving the chair frame portion between a first recumbent position and a second tilted position for assisting a person sitting in the chair to an upright position, said chair frame portion having means for moving said frame portion longitudinally with respect to said stationary base portion, and said lift mechanism having means for disabling said longitudinal moving means when said chair is moved from the first recumbent position, wherein said lift mechanism includes a motor drive assembly attached to a rear part of the stationary base portion upper supporting portion, said longitudinal moving means includes pivot means for pivotally interconnecting said chair frame portion with said lift frame.

2. The lift chair according to claim 1, wherein said disabling means includes at least one planar member having means for interconnecting said lift frame with said chair frame portion when the chair frame portion is moved from said first recumbent position using said motor drive assembly, said interconnecting means preventing independent movement of said chair frame portion.

3. The lift chair according to claim 2, wherein said disabling means includes locking members disposed on lateral sides of said lift frame, each of said locking members including at least one slot formed in a top surface, said disabling means further including a pin member projecting from said chair frame portion which is urged into said at least one slot when said chair frame portion is moved from said first position.

4. The lift chair according to claim 3, wherein said chair frame portion includes a chair seat and a pair of substantially vertical interconnected arm supports, said pin member extending inwardly from said arm supports.

5. The lift chair according to claim 4, wherein the upper supporting portion of said lift frame is disposed beneath said chair seat and includes a pair of longitudinal sections and a front transverse section interconnecting said longitudinal sections, said front transverse section having a support for receiving an output end of a drive piston from said motor drive assembly.

6. The lift chair according to claim 5, wherein said locking members are attached to outward facing sides of said longitudinal sections, said locking members further including biasing means for biasing said locking members in an engagement position relative to the inwardly directed pins of said chair frame section when moved from said first position.

7. The lift chair according to claim 6, including means for moving said locking members to a nonengagement position when said chair frame portion is substantially moved to the first recumbent position.

8. The lift chair according to claim 7, wherein each of said locking members is pivotally attached to the upper supporting portion of said lift frame, said pivotal connection being located between adjacent slots sized for receiving said pin member of said chair frame portion.

9. The lift chair according to claim 8, wherein said biasing means including a tensioning spring attached to a first end of each of said locking members, said release means including a support surface for receiving the remaining end of said locking members when the chair is moved toward the first position, said support surface causing said locking members to pivot the planar member from the engagement position to the nonengagement position.

10. A lift chair according to claim 1, wherein said articulating lever section includes a pair of spaced lever arms pivotally attached to the rear of said stationary base portion at one end.

11. A lift chair according to claim 10, wherein said lift frame includes a pair of front supports having a lower end which pivotally receives the other end of said lever arms of said articulated lever portion and an upper end which is interconnected to said upper supporting portion.

12. A lift chair according to claim 11, including means for adjusting the amount of tilt of said lift frame relating to said stationary base section.

13. A lift chair according to claim 12, wherein said tilt adjusting means includes means for adjusting the pivotal connection point of said lever arms on said front support.

14. A lift chair according to claim 11, wherein said pivot means include at least one pair of pivot arms, each of said pivot arms having an upper end pivotally attached to the upper supporting portion of said lift frame and a lower end attached to the vertical arm supports.

15. A lift chair according to claim 14, wherein said arm supports include front and rear leg sections, said chair including a front pair of pivot arms and a rear pair of pivot arms attached to respective front and rear legs of each vertical arm support.

16. A lift chair according to claim 15, wherein each of said pairs of swings are interconnected by a transverse axle member.

17. A lift chair according to claim 1, including means for reclining said chair frame portion independently of said stationary base and said lift mechanism.

18. A lift chair according to claim 17, wherein said reclining means include an adjustable lever which is movable to allow an independent angled movement of said chair frame portion relative to said stationary base portion.

19. A lift chair according to claim 1, including means for adjusting the amount of tilt of said lift frame relative to said base portion.

20. A lift chair according to claim 1, wherein said motorized lift mechanism includes a motor drive housing which is stationarily mounted to said base portion.

* * * * *